US006758334B2

(12) United States Patent
Uner et al.

(10) Patent No.: US 6,758,334 B2
(45) Date of Patent: Jul. 6, 2004

(54) GOLF BAG

(75) Inventors: Randy Uner, Jensen Beach, FL (US); Don Schuneman, Witchita, KS (US)

(73) Assignee: Kart-N-Kourse Golf, Inc., Jensen Beach, FL (US)

( * ) Notice: Subject to any disclaimer, the term of this patent is extended or adjusted under 35 U.S.C. 154(b) by 0 days.

(21) Appl. No.: 10/155,581

(22) Filed: May 22, 2002

(65) Prior Publication Data

US 2002/0195359 A1 Dec. 26, 2002

Related U.S. Application Data

(63) Continuation-in-part of application No. 09/695,524, filed on Oct. 24, 2000, now Pat. No. 6,499,593.

(51) Int. Cl.[7] ..... A63B 55/00
(52) U.S. Cl. ..... 206/315.3; 190/110
(58) Field of Search ..... 206/315.2–315.6; 224/918, 919; 211/70.2, 70.5, 60.1, 69.5; 280/DIG. 5, DIG. 6; 190/108–111; 150/111–113, 117

(56) References Cited

U.S. PATENT DOCUMENTS

| | | | | | |
|---|---|---|---|---|---|
| 3,696,850 | A | * | 10/1972 | Rosenblum | 190/108 |
| 4,282,912 | A | * | 8/1981 | Brown | 206/315.5 |
| 4,858,761 | A | * | 8/1989 | Fumia | 206/315.3 |
| 4,883,207 | A | * | 11/1989 | McArthur | 482/97 |
| 5,358,109 | A | * | 10/1994 | Nichols | 206/315.3 |
| 5,472,084 | A | | 12/1995 | Aliano, Jr. | 206/315.3 |
| 6,098,769 | A | * | 8/2000 | Yen | 190/108 |
| 6,126,050 | A | * | 10/2000 | Aliano, Jr. | 292/6 |
| 6,149,041 | A | * | 11/2000 | Perino et al. | 224/645 |
| 2002/0066763 | A1 | * | 6/2002 | Hsuen | |

FOREIGN PATENT DOCUMENTS

| | | | | |
|---|---|---|---|---|
| WO | WO 91/18650 | * | 12/1991 | 206/315.5 |

OTHER PUBLICATIONS 6 pg Piggy Back Golf Bag Brochure, date unknown.
Press Release, "Piggy Back Gold Bag Provides Golfers with Solution for Slow Play" (No date).
Press Release, True Life Rocky Theme Unfolds with Launch of Piggy Back Golf Bag—Philadelphia, PA Nov. 6, 2000.
Press Release, "Joseph Aliano FTN" (No date).
Press Release, Classic Finish Golf Sign Exclusive Agreement Martin's Golf & Tennis Shop—Philadelphia, PA Sep. 8, 2000.
Article, New Gold Accessories for 2000, Golf Illustrated—by: Laurie Lee Dovey, Equipment Editor (No date).
Article, Bag technology that can help make the game better—by: Seth Fox (No date).
Article, Golf isn't NASCAR, but speed counts, too Speed Counts, Golf Guide; Community News, Del Apr., 2001—by Reid Champangne.
Article, "Ready for "Ready Golf""—Florida Golf Central; Nov. 2000—by: Carlton Vinson.
Article, Piggy Back Golf Bag, The Times Herald—Feb. 5, 2001.
Article, Locals Display wares at PGA Show, Daily Local News, Feb. 8, 2001—by: Reid Champagne.
Article, Christmas Gift Ideas for the Golfer on Your List, Sun Herals—by: Grant Boxleitner (No date).
Article, The Good Stuff, People, Places and Things, Chicago Golf Magazine—by: Bill Daniels (No date).
Article, Piggy Back Golf Bag, PGA Tour Partner's Magazine, Jul./Aug. 2000.
Photos of bag purchased by Applicant on May 30, 2001 with Accompanying CD containing photos.
PGA Reviews by Steve Pile.

* cited by examiner

*Primary Examiner*—Lien T M Ngo
(74) *Attorney, Agent, or Firm*—Vidas, Arrett&Steinkraus PA

(57) ABSTRACT

A full-sized golf bag of variable configuration having a detachable smaller golf bag that may be used to carry a small number of clubs to a remote chosen location.

22 Claims, 14 Drawing Sheets

GOLF BAG

RELATION TO OTHER APPLICATIONS

This application is a continuation-in-part of U.S. patent application Ser. No. 09/695,524, filed Oct. 24, 2000, now U.S. Pat. No. 6,499,593, which is herein incorporated by reference in its entirety.

FIELD OF INVENTION

The invention pertains to a golf bag. More particularly, a golf bag which comprises a main bag and a smaller carrying bag, wherein the carrying bag is removably attached to the main bag.

BACKGROUND OF THE INVENTION

The present invention relates to golf bags. Conventionally, bags of this type are constituted by rigid and/or semi-rigid containers which are fairly voluminous and are provided with club-carrying compartments, as well as with further integral accessory-carrying compartments or pockets. These bags may either be carried by a golfer or they may be attached to a pull cart or a golf cart. In many instances the bags are not suitable for carrying on the shoulder due to their bulk and weight. Furthermore, these bags in many instances have irregular shapes, often with bulky bulging portions, and are thus inconvenient in use and difficult to place when not in use. The present invention is directed to relieving problems and inconveniences that may arise with an overly heavy and bulky golf bag.

One particular problem that arises is the situation a golfer finds himself in when the player's ball is in a lie unseen from the player's cart. Many times golf courses have designated areas which are off limits to golf carts, and sometimes physically unreachable in the golf cart. This is may be the case when golf courses require that the carts stay on a designated path. A golfer's ball may be on the opposite side of the fairway. Similarly, access to a position in close proximity to the greens is almost always restricted. It is in these situations that the golfer must investigate his lie prior to choosing his club. Many times a golfer will take a number of clubs from his bag and carry them to his ball. This can be an inconvenient situation because the golfer may have to carry many clubs as the position and lie of the ball can markedly alter ones club selection. Still further, carrying a number of loose clubs to ones ball, as every golfer knows, may result in a lost club by overlooking one or two of the clubs which are not used for the shot when the golfer returns to his cart.

Reicherstorfer (WO 91/18660) and Aliano, Jr. (U.S. Pat. No. 5,472,084) disclose bags having detachable carrying bags. However, the coupling mechanisms which these bags use are difficult to use, in that the carrying bag is not easily removable, and/or are aesthetically awkward, in that they are in plain sight and add clutter to the overall appearance. These bags are also undesirable due to their punitive cost. There is a need for a dual carrying bag system which comprises a coupling mechanism which can be easily used, which is aesthetically pleasing and which has an expectable cost.

The present invention provides for all of these needs. It allows for all the advantages of a conventional golf bag in addition to a small detachable carrying bag. With the present invention, the golfer will be able to secure the golf bag to a carrying device, such as a golf cart, and easily detach a small portion of the bag to carry a small number of clubs to a remote site on the golf course, without having to carry the entire bag. The coupling mechanism is easily operated by a user with one hand. The mechanism is also hidden from view when the bags are coupled and does not add to the clutter of the outward appearance. The bag is also economically favorable.

All US patents and applications all other published documents mentioned anywhere in this application are incorporated herein by reference in their entirety.

Without limiting the scope of the invention in any way, the invention is briefly summarized in some of its aspects below.

SUMMARY OF THE INVENTION

The object of the present invention is to avoid the above problems and to produce a bag, particularly but not exclusively a golf bag, which allows the user to easily and rapidly remove a small portion of the bag to carry a small number of clubs. The present invention also provides for a hidden coupling mechanism which is aesthetically pleasing and which is not financially punitive.

In order to achieve these objects, the subject of the invention is a bag, particularly but not exclusively a golf bag, characterized in that it comprises a main bag and a smaller carrying bag, capable of carrying approximately 1–5 clubs. When the two bags are joined, the resulting configuration is typical of a conventional golf bag. However, the user may easily detach the carrying bag with one hand via a hidden coupling mechanism which secures the two bags together and carry a small number of clubs to a remote area of the course without having to carry the entire bag. This allows the user to leave a majority of the bag and clubs in a particular place, such as the golf cart, while using a small portion of the overall bag to carry a small number of clubs to an area remote from the position of the main bag.

In the particular case of a golf bag, the accessories which complete the equipment of the bag are the conventional elements of a golf bag, such as, but not limited to, a carrying handle, the shoulder-strap, umbrella holder, ball holder, the rain hood (which can be fitted to cover the clubs and is in turn detachable from the assembly and can even be folded between the two club-carrying compartments and the accessory-carrying bag when it is not in use), any pockets formed on the outside of the club-carrying compartments for carrying items which are bulky and not bulky (score-cards, tees, markers, gloves, etc.).

Structurally, there are no limits to the type of material which can be used for the various components, in that the club-carrying compartments and the accessory-carrying bag can be made equally well with soft walls (artificial leather, leather; textile) or with rigid walls (laminated resin, plastics material; metal; cellulose compounds, etc.) The rigidity necessary for the stress points intended to support the loads or to provide the force required may be achieved by local reinforcement or reinforcement of the whole length. The general geometrical shape of the bag can vary.

Although the use of the bag according to the invention as a golf bag is particularly advantageous, different uses, such as a traveling bag or suitcase, can be considered just as convenient.

BRIEF DESCRIPTION OF THE DRAWINGS

The invention will now be described in detail with reference to the appended drawings, provided purely by way of non-limiting example, in which.

DETAILED DESCRIPTION OF THE INVENTION

Figure 1:
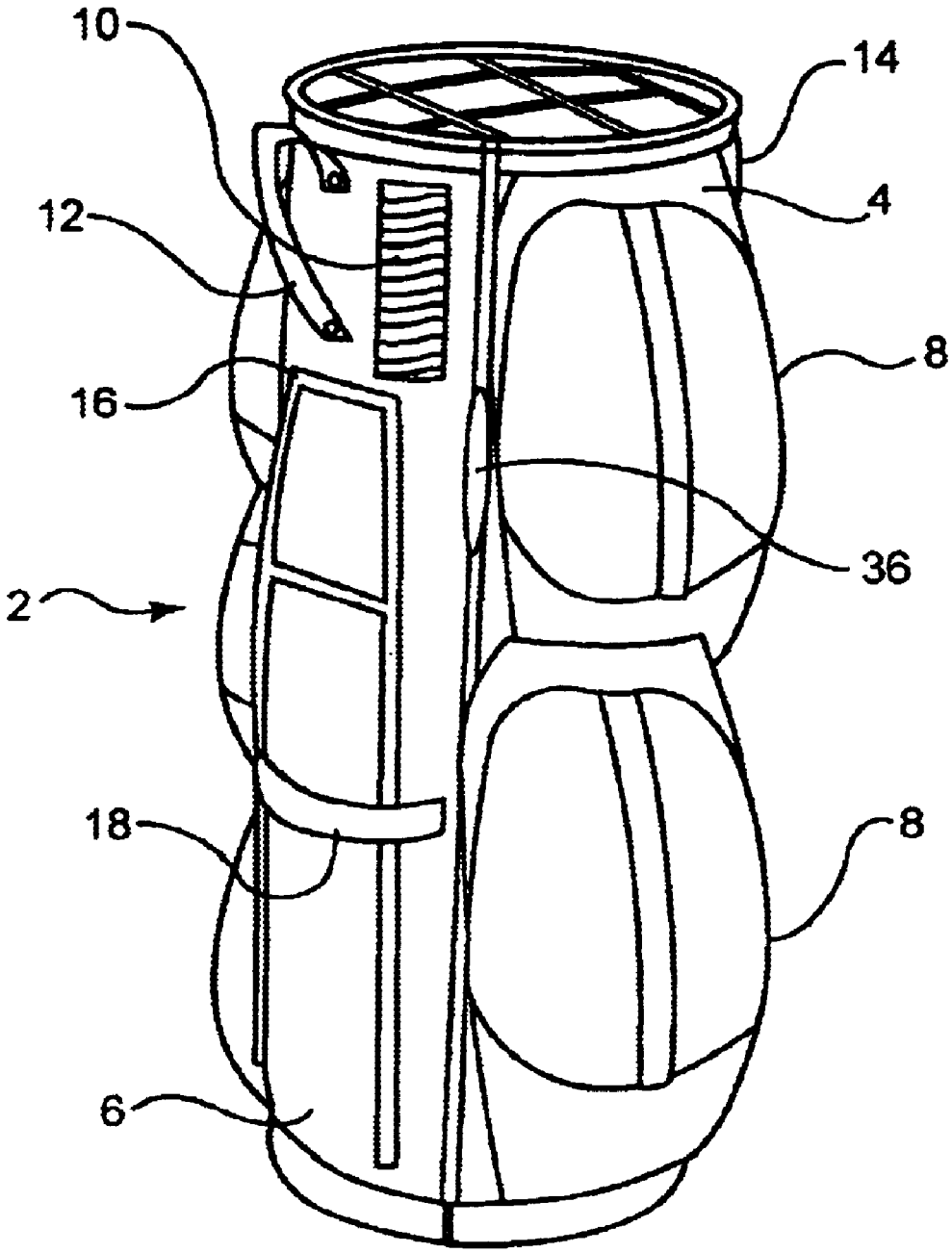
FIG. 1 is a perspective frontal view of a golf bag according to the invention.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, unless otherwise indicated, identical reference numerals used in different figures refer to the same component.

A detailed description of illustrative embodiments of the impression system according to the invention is given herein below with reference to the attached drawings, and possible modifications are discussed by way of conclusion.

The following statement applies to the whole of the description. If, for the purposes of clarity of the drawings, reference numbers are included in a figure but are not mentioned in the directly associated text of the description, then reference is made to their mention in preceding figure descriptions. In the interests of intelligibility, the repeated designation of components in succeeding figures is for the most part omitted, if it is clear from the drawings that the components concerned are "recurring" components.

Figure 2:
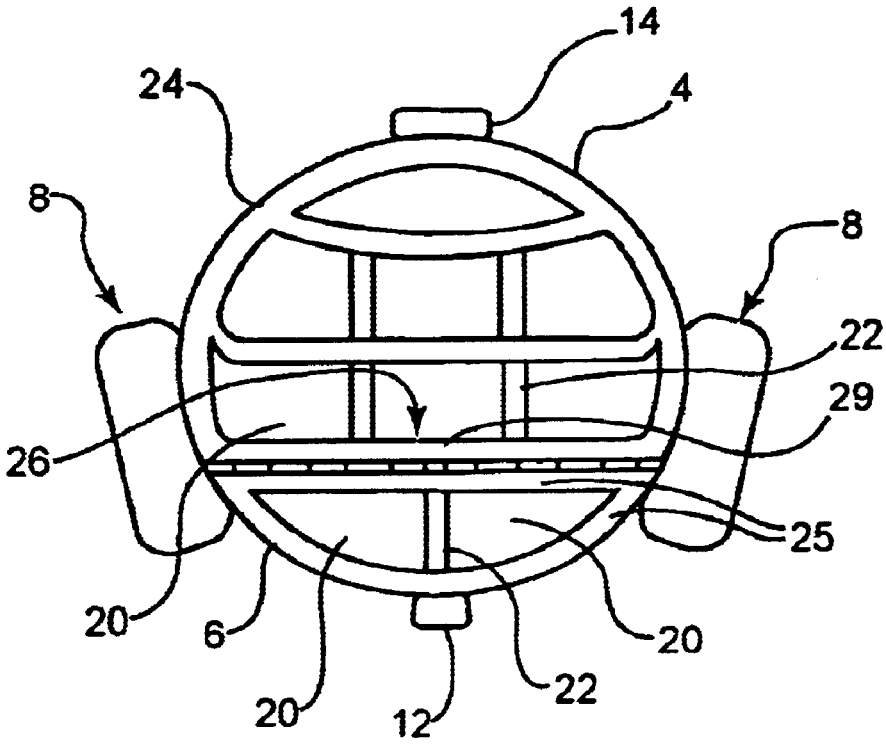
FIG. 2 is a top view of the bag.

With reference initially to FIGS. 1 and 2, a bag according to the invention is generally indicated 2 and can be used primarily as a golf bag for carrying golf clubs and golf accessories. The bag 2 comprises essentially a main bag 4 and a smaller carrying bag 6. The carrying bag 6 is detachable from the main bag 4, allowing the golfer to carry a small amount of clubs to a position on the golf course without removing the heavier and bulkier main bag 4 from the golf cart to which the bag is attached. It should be understood that the bag 2 does not necessarily have to be used only with a golf cart. The present invention may be used in any situation in which the golfer wishes to carry a small amount of clubs to a specific position on the course without having to carry the entire weight and bulk of the golf bag.

The various features on golf bags, such as pockets, compartments and holders for golf accessories are well known in the art and may be incorporated in the bag 2. Such items shown in the figures are primarily illustrative. It should be understood that the present invention is not limited to only the accessory features shown. Other well known features for carrying accessories may be added without frustrating the detachable carrying bag construction.

FIG. 1 illustrates some of these features. In this particular embodiment, zippered side pockets 8 are positioned on the side of the main bag 4. FIG. 1 shows these pockets 8 on the side for easy access when the bag 2 is strapped onto a golf cart. Pockets of various sizes may be distributed on any portion of the main bag 4 or the carrying bag 6 where functionally feasible. Also shown is ball pocket 10 for easy access to additional balls and grab handles 12, 14 for carrying the carrying bag 6 and the main bag 4, respectively. A shoulder strap (not shown) may also be attached to the main bag 4 for easier toting of the bag 2.

Also illustrated is a gravity stand 16. In this particular embodiment, the stand 16 is attached to the carrying bag 6 and hinged at the top. This allows the golfer to prop up the carrying bag 6, or the entire bag 2 if the carrying bag 6 is still attached to the main bag 4, in a generally up-right position. This allows the golfer easier access to clubs and prevents the bag from getting soiled if it were placed on the ground. This particular stand 16 is a gravity stand. It is merely hinged with a limited arc allowing for an acute angle. A strap 18 is provided to hold the stand 16 place against the carrying bag 6 when it is not in use. It should be recognized that there are a wide variety of stands that are well known. Some stands are removable from the bag and some are permanently attached to the bag. Automatic stands are also popular. The present stand 16 can be replaced with an automatic stand. In such a case, the bottom of the carrying bag is outfitted with a trigger, such as a plate trigger or an arm trigger, which under the weight of the bag causes, through a leverage mechanism, the stand to spring outward to an acute angle to support the bag in a stand-up position on the ground. Otherwise, when the bag is not sitting on the ground, the stand is urged against the bag. The present invention is only limited to the incorporation of a stand which is functionally feasible and not to the stand shown in FIG. 1, which serves primarily for illustrative purposes.

FIG. 2 shows the top of the bag 2. As can be seen, both the main bag 4 and the carrying bag 6 have a golf club separator arrangement comprising a number of openings 20 to receive golf clubs. These openings 20 are defined by both the perimeter of the bags 24, 25 and separators 22. The separator arrangement and number of openings may be dictated by preference. Conventional arrangements are designed to provide separation of the clubs for easy access to a particular club. Some arrangements provide separators 22 that extend partially or completely down the length of the bag to prevent tangling of the grip ends of the clubs. Varied golf club separator arrangements are well known. The arrangement shown in the FIGS. should not be considered limiting as the illustrated arrangement may be altered according to preference. In the this particular illustrative arrangement the main bag 4 has a configuration of separators 22 allowing for seven openings 20, which the carrying bag 6 has one separator 22 allowing for two openings 20. FIG. 1 also shows that the separator arrangement has a shallow configuration. That being, the separators have limited length relative to the length of the bag 2. It should be understood that the length of the separators may be varied according to preference.

It should be understood that the ability to easily remove the carrying bag 6 from the main bag 4 and the hidden nature of the attachment mechanism are the guiding foci of the present invention. As can be seen in FIGS. 1-2, the mechanism which holds the bags 4, 6, together is not readily evident. The rapid/quick release mechanism/connection through which the carrying bag 6 is connected to, and removed from, the main bag 4 may vary provided that carrying bag 6 may be removed without inconvenience on the golf course. The present quick release mechanism may be activated easily using one hand.

Figure 3:
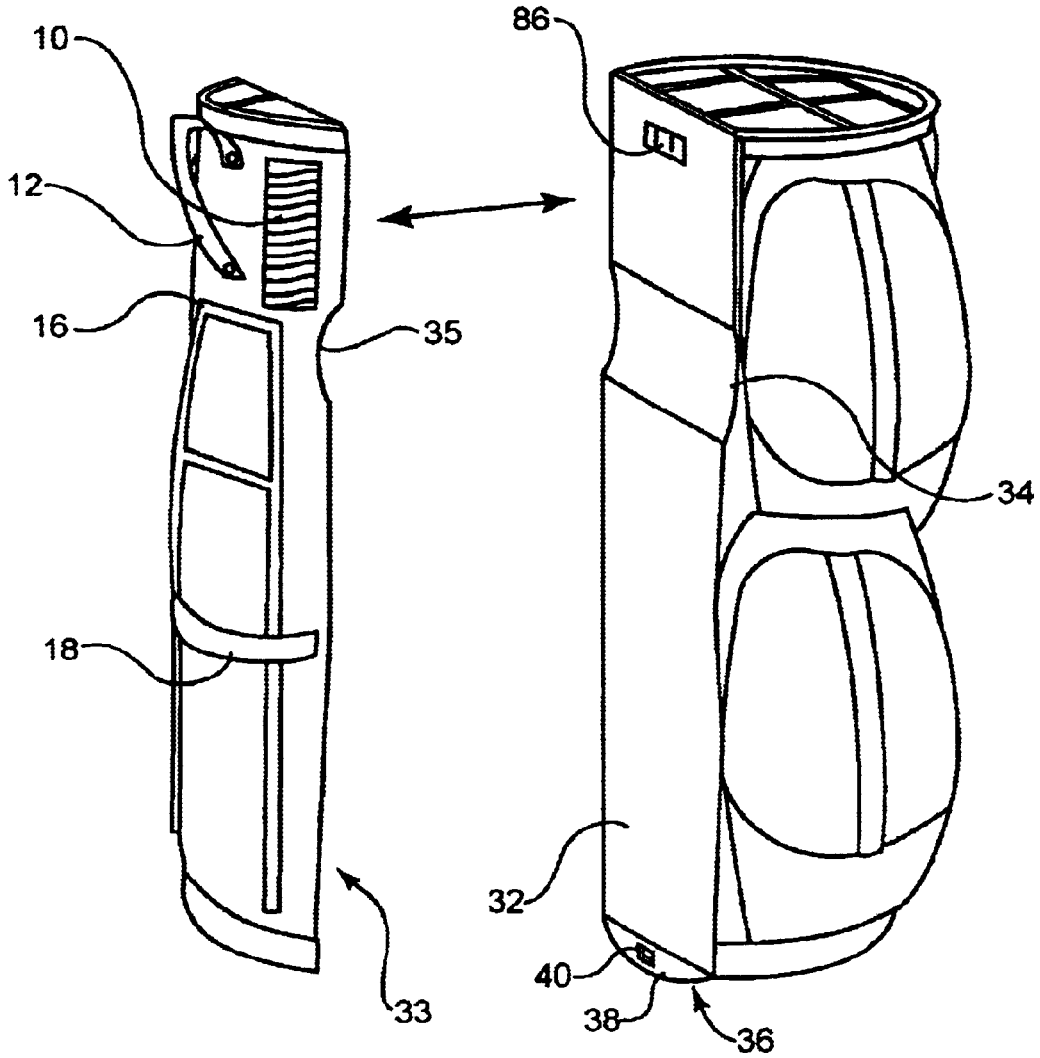
FIG. 3 is a perspective view which shows the carrying bag removed from the main bag.

The separation of the carrying bag 6 and the main bag 4 is illustrated in FIG. 3. As can be seen in these figures, the inner surface 32 of the main bag 4 is configured to give the impression that the portion which constitutes the carrying bag 6 is cut away from the bag 2. Inner surface 32 is relatively flat so as to mate relatively uniformly with the opposing relatively flat inner surface 33 of the carrying bag 6. It is preferred that the inner surfaces of the bags mirror each other so as to give the impression of a complete bag when they are coupled.

The inner surfaces 32, 33 preferably incorporate mirroring concave strips 34, 35. These strips provide a conduit 36 (as seen in FIG. 1) for the strap that holds the bag 2 on the golf cart. This allows the golfer to remove the carrying bag 6 without having to remove the strap which holds the bag 2 on the golf cart. With the carrying bag 6 removed, the main bag 4 stays secured to the golf cart.

FIGS. 4–8 illustrate an attachment mechanism which provides the connection between the top portion of the carrying bag 6 with the top portion of the main bag 4 and which is easily used and hidden from view when the bags are coupled. In this particular embodiment, the mechanism is located partly on the inner surface 33 of the carrying bag 6 and partly on the inner surface 32 of the main bag 4. In the embodiment shown in FIGS. 4–8, the coupling mechanism is centered on the inner surfaces 32, 33. The positioning of the coupling mechanism is conveniently hidden when the carrying bag 6 is coupled to the main bag 4. As will become clear, the attachment mechanism is designed for one to use with one hand with ease.

Figure 4:
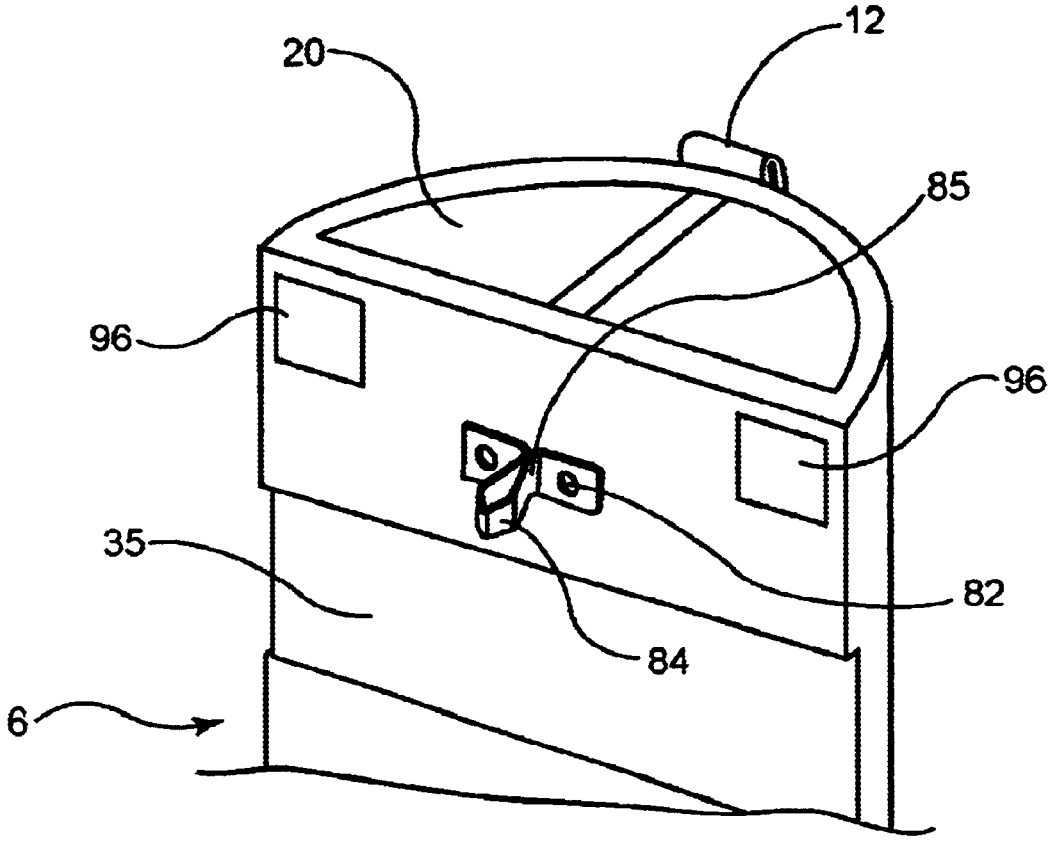
FIG. 4 is a perspective view of the top portion of the main bag in a particular embodiment.

FIG. 4 shows the inner surface 33 of the carrying bag 6. The coupling mechanism contemplated is a catch mechanism which allows the bags 4, 6, to be secured to one another in one motion with the inner surfaces 32, 33, substantially flush against one another, essentially hiding the coupling mechanism. The drawings show a steel spring cushioned double roller catch with strike. However, other catch mechanisms are contemplated, including friction catches, magnet catches and other types of roller catches. The catches used should be capable of coupling and uncoupling without direct manipulation of the catch itself. For example, the catch shown may be coupled and uncoupled by pushing or pulling the carrying bag 6 against and away from the main bag 4 via the handle 12 of the carrying bag 6.

A male portion or latch 82 of the catch mechanism is attached to one of the bags. In this case it is attached to the carrying bag 6 via bolts or screws. The latch has a recess portion 85 and a head 84, which extends outward from the inner surface 33 of the carrying bag 6.

Figure 5:
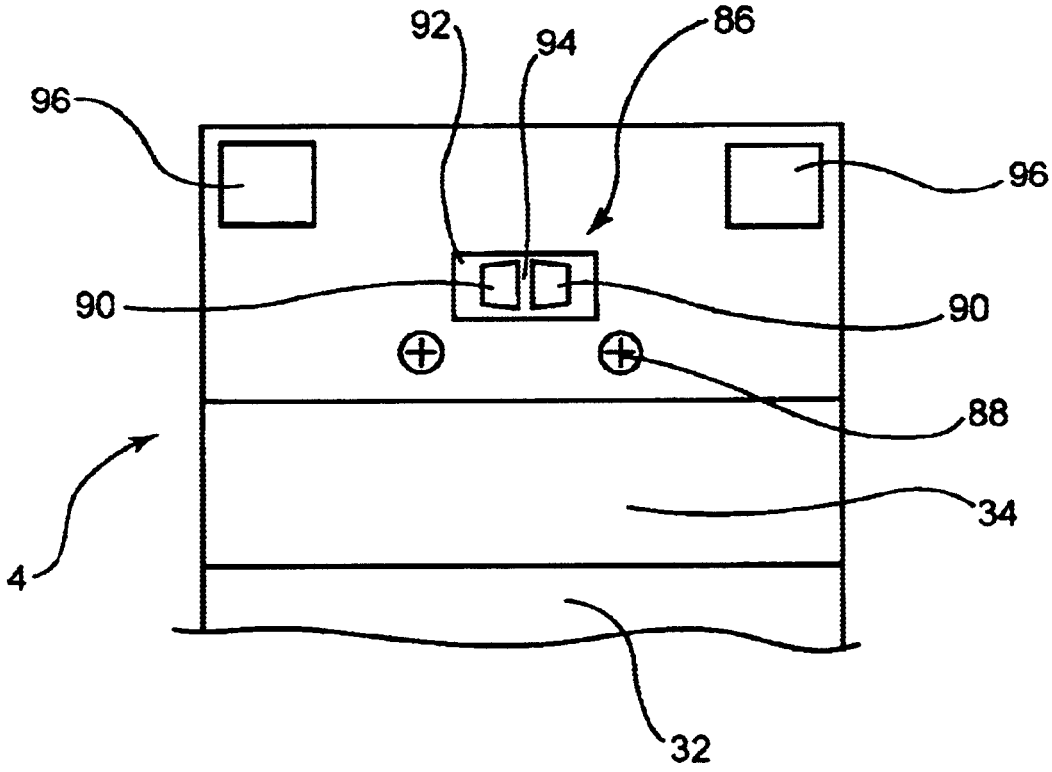
FIG. 5 is a side view of the top portion of the carrying bag in the particular embodiment.

The latch 82 is received by a catch or strike 86, which, as seen in FIG. 5, is positioned on the inner surface 32 of the main bag 4. The catch 86 is preferably substantially recessed in an opening 92 in the inner surface 32 of the bag 4 so as to allow the inner surfaces 32, 33, to be substantially flush with one another. This particular catch is a spring cushioned double roller catch. The catch 86 may be connected to the inside of the inner surface 32 of the bag 4 via screws 88, or some other form of conventional means. The rollers 90 of the catch 86 are laterally movable so as to receive the latch 82 between them 94

For additional support and stabilization, pads 96 made of hook and loop material, such as VELCRO, or magnetic materials are positioned on both of the inner surfaces 32, 33. In the particular embodiment shown, the pads 96 are located in the upper corners. When the bags 4, 6, are coupled, the opposing pads 96 of each bag are joined, removing any unnecessary play.

Figure 8:
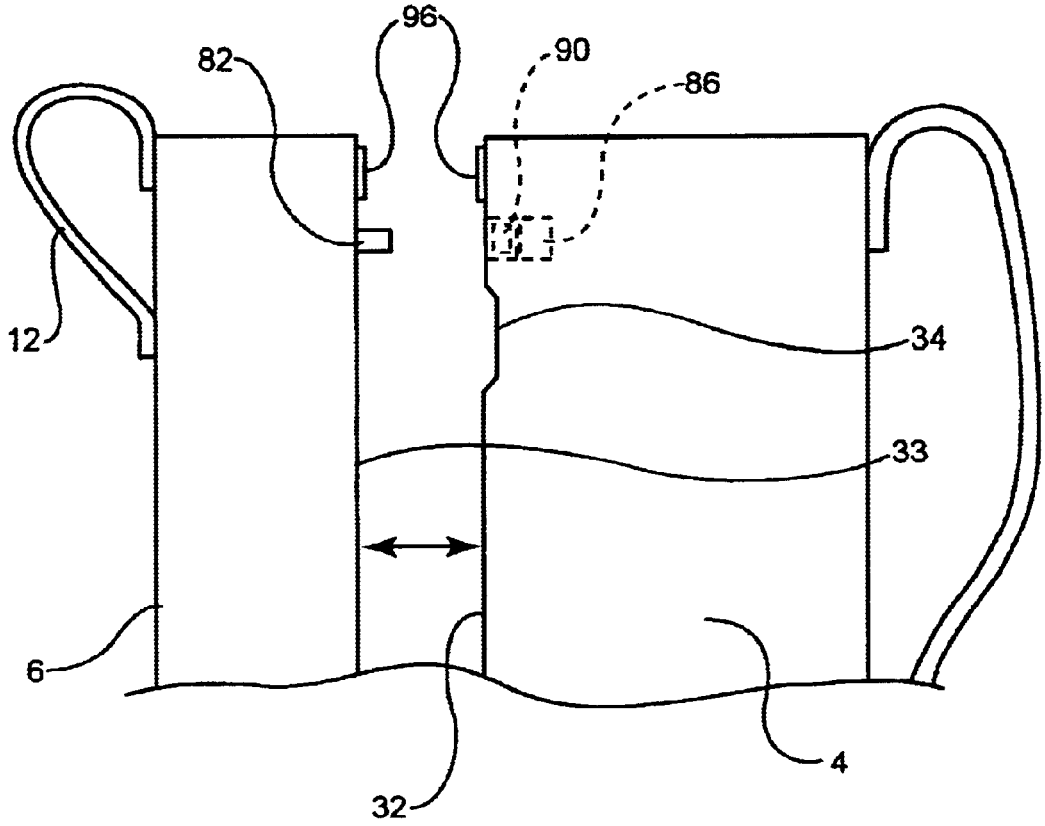
FIG. 8 is an exploded side view of the golf bag, showing a portion of the roller catch in phantom.

FIG. 8 shows the coupling of the bags 4, 6, from the side. In this view, the recessed positioning of the catch 86 and the protruded positioning of the latch 82 can be seen. As can be seen, the positioning of the latch 82 and the catch 86 allow the inner surfaces 32, 33, to come together in a flush manner.

Figure 6:
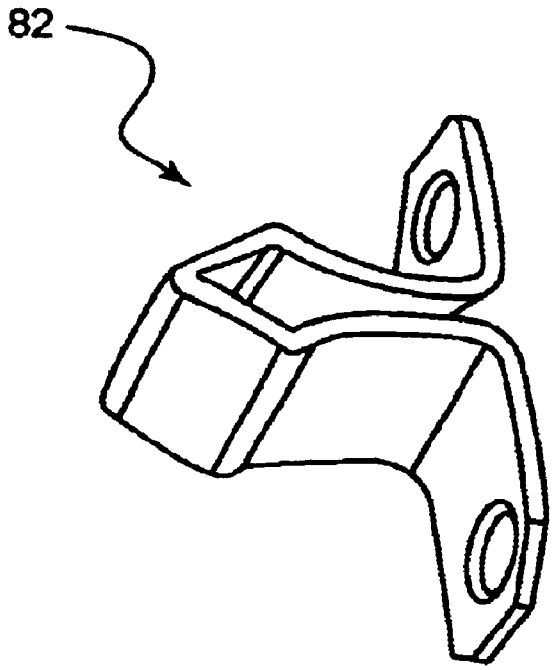
FIG. 6 is a perspective view of a male portion of a roller catch.
Figure 7:
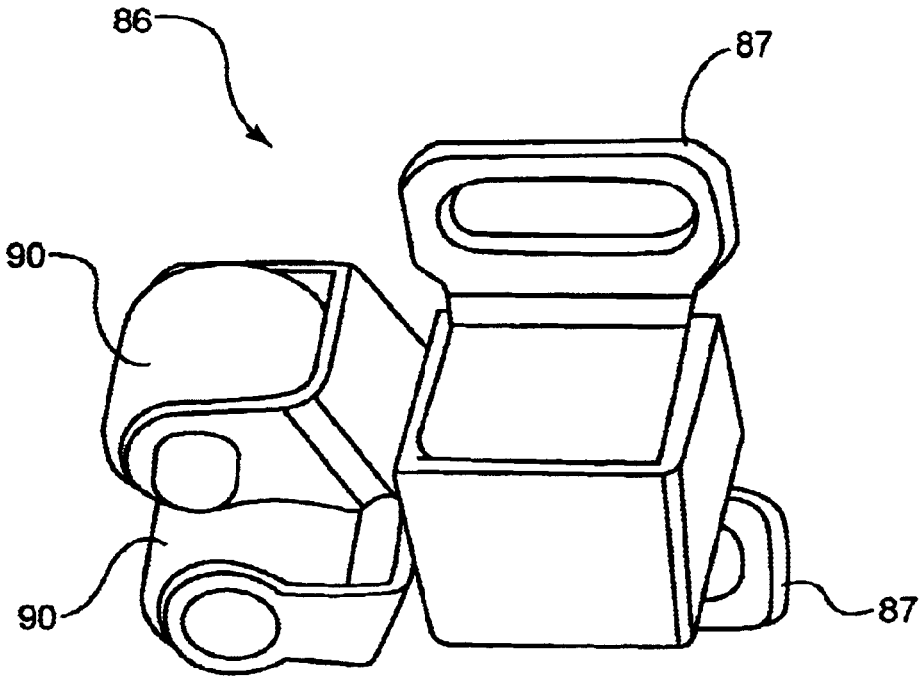
FIG. 7 is a perspective view of a female portion of a roller catch.

FIGS. 6–7 show an example of a possible coupling mechanism for the upper portions of the bags 4, 6. FIG. 6 illustrates a latch 82 and FIG. 7 illustrates a catch 86. The catch 86 has projections 87 which are used to fasten the catch 86 to the bag via screws or other known methods. The fastening of the catch 86 and latch 82 to the bag may be accomplished with any conventional means. The specific configurations of the mechanism shown in FIGS. 6–7 are not meant to limit the invention. Other mechanisms are contemplated, as mentioned above. Self-connecting mechanisms are contemplated, that being, mechanisms which do not require direct manipulation for their connection and do not affectively impede the mating of the inner surfaces 32, 33. Such mechanisms are generally referred to as cabinet latches. Friction catches, magnet catches and roller catches are general designations.

Figure 9:
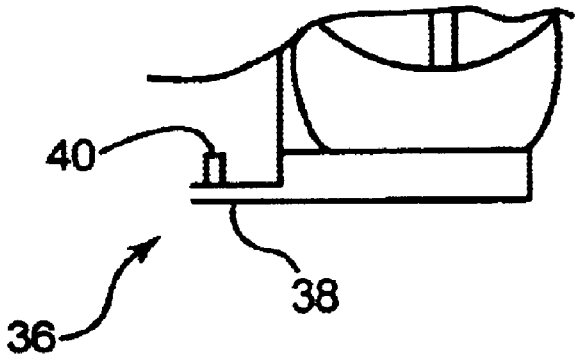
FIG. 9 is a side view of the bottom of the main bag.
Figure 10:
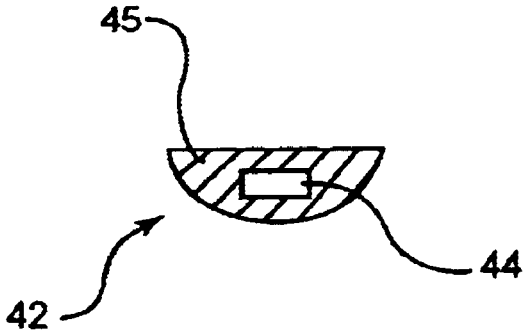
FIG. 10 is a bottom view of the carrying bag.

The quick release connection of the present embodiment also comprises a coupling/attachment mechanism between the bottom of the carrying bag 6 and the main bag 4. This coupling mechanism works in conjunction with the upper attachment mechanism to secure the carrying bag 6 to the main bag 4. FIGS. 3 and 9–10 illustrate the coupling mechanism of this particular embodiment. As mentioned above, it should be understood that a wide variety of coupling mechanisms or attachment mechanisms may be employed as long as the carrying bag can be quickly removed from the main bag. The mechanism shown is also hidden from sight when the bags are coupled. It also allows for a one handed attachment.

The coupling mechanism between the bottoms of the bags demonstrated by FIGS. 3 and 9–10 is a basic mating arrangement which cooperates easily with the upper attachment mechanism. This particular arrangement comprises a male post arrangement 36 which comprises a partial plate 38 and a post 40. FIG. 10 illustrates the female arrangement 42, which, in this embodiment, comprises a receptacle 44, in this case an opening 44 in the bottom 45 of the carrying bag 6, for receiving the post 40. In practice, in the present embodiment, the upper attachment mechanism and the coupling mechanism are engaged relatively at the same time, cooperating together to secure the carrying bag 6 to the main bag 4.

Figure 11:
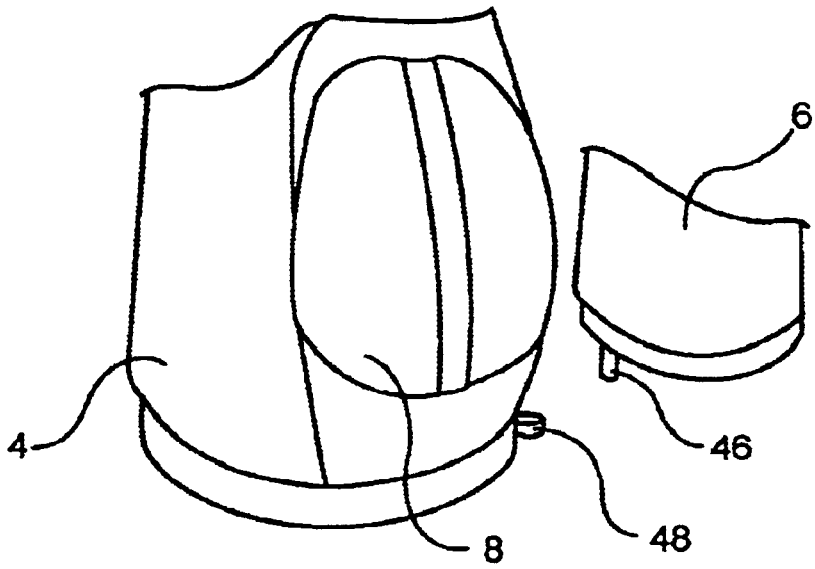
FIG. 11 is a perspective frontal view of the bottom of the bag showing an alternative embodiment of the lower attachment between the carrying bag and the main bag.

FIG. 11 illustrates an alternative embodiment of the coupling mechanism, wherein the mechanism is reversed. In this particular situation, the carrying bag 6 incorporates the post 46 and the main bag 4 incorporates the receptacle 48, which in this case is a loop.

Figure 12:
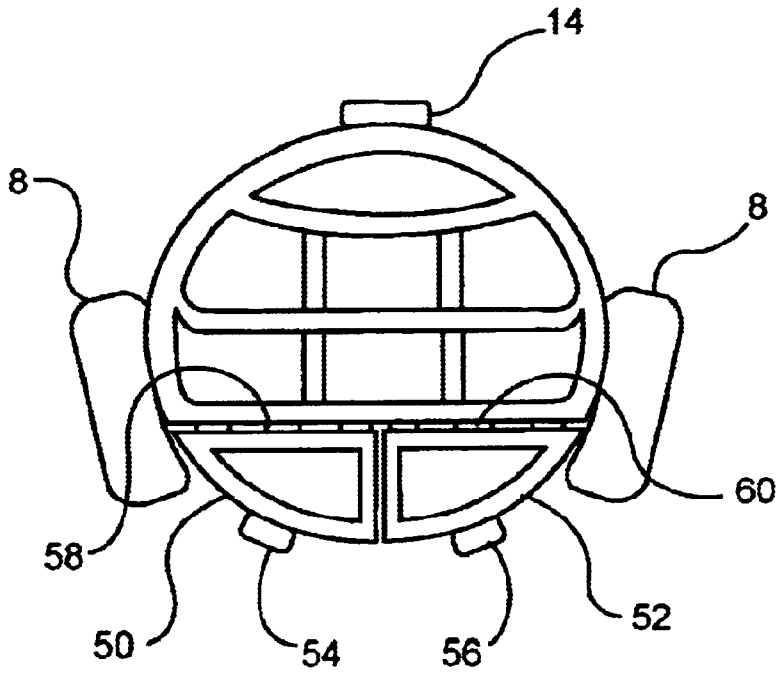
FIG. 12 is a top view of an alternative embodiment of the invention.
Figure 13:
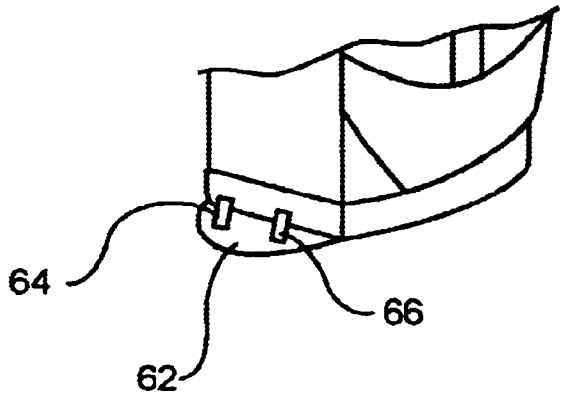
FIG. 13 is a bottom view of the dual carrying bags of the alternative embodiment of the invention.
Figure 14:
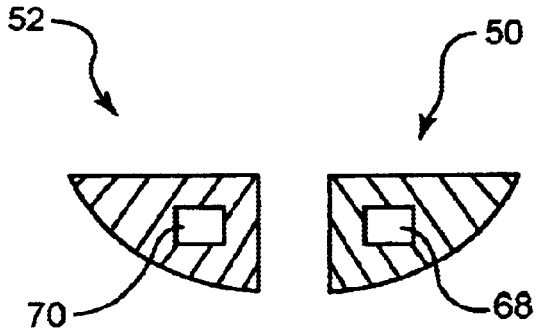
FIG. 14 is a side perspective view of the bottom of the main bag of the alternative embodiment of the invention.

FIGS. 12–14 illustrated an alternative embodiment of the invention. In this particular case, there are two carrying bags

50, 52, each having a separate bag handle 54, 56, rather than one carrying bag 6. For example, this allows the golfer to keep some wedges and a putter in one carrying bag permanently, leaving an extra carrying bag for other situations.

The quick release connection illustrated is essentially the same as shown in FIGS. 4–5 and 9–10 and described above. The attachment mechanisms 58, 60 shown in this embodiment of FIG. 12 are essentially the same as the attachment mechanism shown in FIGS. 4–5.

FIGS. 13–14 illustrate the lower coupling mechanism for the dual carrying bags, which is essentially the same as the one shown in FIGS. 9–10, differing in that there are two carrying bags instead of one. FIG. 13 shows a partial plate 62 cooperating with a pair of posts 64, 66 to receive the receptacle openings 68, 70 positioned on the bottom of carrying bags 50 and 52. As with the lower coupling mechanism shown in FIGS. 9–10, these mechanisms are also hidden from view when the bags are coupled.

In general, the material used for the bags comprises those materials conventionally used in making golf bags. Preferably, the inner sides 32, 33 are made of a rigid material for added support.

Furthermore, although specific reference has been made to the use of the bag according to the invention as a golf bag in the example illustrated, the same utility and advantages of the invention also extend to different uses of the bag, for example, to its use as a traveling bag or suitcase.

We claim:

1. A golf bag of variable configuration comprising a main golf club carrying bag having a length and a smaller golf club carrying bag having a length, an upper portion and a lower portion, the smaller golf club carrying bag being detachably coupled to the main golf club carrying bag, the smaller golf club carrying bag and the main golf club carrying bag each having a first outer surface along their lengths, each first outer surface comprising an upper portion and a lower portion, wherein the first outer surfaces face one another and are substantially hidden from view when the smaller golf club carrying bag and the main golf club carrying bag are fully coupled, the golf bag further comprising a coupling mechanism, the coupling mechanism being capable of fully coupling the smaller golf club carrying bag and the main golf club carrying bag together, wherein the coupling mechanism is hidden from view when the smaller golf club carrying bag and the main golf club carrying bag are fully coupled, the coupling mechanism further comprising an upper male portion and an upper female portion, wherein the upper male portion and the upper female portion engage one another to couple the upper portions of the first outer surfaces of the smaller golf club carrying bag and the main golf club carrying bag and wherein the upper male portion and the upper female portion are insularly positioned on the upper portions of the first outer surfaces of the smaller golf club carrying bag and the main golf club carrying bag, such that, when the upper portion of the first outer surface of the smaller golf club carrying bag is drawn toward the upper portion of the first surface of the main golf club carrying bag from a separated, face-to-face position and fully coupled with the main golf club carrying bag, the upper male portion and the upper female portion engage and are substantially hidden from view, wherein, when the bags are coupled, a conduit is formed laterally between the bags, the conduit being sized to receive a retaining strap from a golf cart, the conduit being formed via lateral inset portions across the outer surfaces of the two carrying bags.

2. The golf bag of claim 1, wherein the upper male portion protrudes from one of the first outer surfaces toward the other golf club carrying bag when the golf club carrying bags are in a position to be coupled.

3. The golf bag of claim 2, wherein the upper female portion is inset within one of the first outer surfaces opposite the upper male portion.

4. The golf bag of claim 1, wherein the upper female portion and the upper male portion are substantially laterally centered on the first outer surfaces.

5. The golf bag of claim 4, wherein the upper female portion is a catch inset within the first outer surface of the main golf club carrying bag and the upper male portion is a latch protruding from the first outer surface of the smaller golf club carrying bag.

6. The golf bag of claim 5 further comprising a hook and loop patches applied to the first outer surfaces to further secure the smaller golf club carrying bag to the main golf club carrying bag.

7. The golf bag of claim 1, wherein the coupling mechanism is constructed and arranged such that, when the main golf club carrying bag is secured, one may fully couple the smaller golf club carrying bag to the main golf club carrying bag with no more than one hand.

8. The golf bag as in claim 1, the coupling mechanism further comprising a lower attachment mechanism being associated with the bottom portion of the smaller golf club carrying bag and the main golf club carrying bag, lower attachment mechanism connecting the bottom portion of the smaller golf club carrying bag to the bottom portion of the main golf club carrying bag.

9. The golf bag as in claim 8, wherein the lower attachment mechanism comprises a post and receptacle configuration, the post being received by the receptacle to connect the bottom portion of the smaller golf club carrying bag with the bottom portion of the main golf club carrying bag.

10. A golf bag of variable configuration comprising a main golf club carrying bag having a length and a smaller golf club carrying bag having a length, an upper portion and a lower portion, the smaller golf club carrying bag being detachably coupled to the main golf club carrying bag, the smaller golf club carrying bag and the main golf club carrying bag each having a first outer surface along their lengths, wherein the first outer surfaces are substantially flat and face one another and are substantially hidden from view when the smaller golf club carrying bag and the main golf club carrying bag are fully coupled, the golf bag further comprising a coupling mechanism, the coupling mechanism being capable of fully coupling the smaller golf club carrying bag and the main golf club carrying bag together, wherein the coupling mechanism is constructed and arranged such that, when the main golf club carrying bag is secured, one may fully couple the smaller golf club carrying bag to the main golf club carrying bag with no more than one hand, the coupling mechanism further comprising an upper male portion and an upper female portion, wherein the upper male portion and the upper female portion engage one another to couple the top portions of the smaller golf club carrying bag and the main golf club carrying bag and wherein the upper male portion and the upper female portion are insularly positioned on the first outer surfaces of the smaller golf club carrying bag and the main golf club carrying bag, such that when the smaller golf club carrying bag is fully coupled with the main golf club carrying bag, the upper male portion and the upper female portion are substantially hidden from view, the coupling mechanism further comprising a lower attachment mechanism being associated with the bottom portion of the smaller golf club carrying bag and the main golf club carrying bag, lower attachment mechanism connecting the bottom portion of the smaller golf club carrying bag to the bottom portion of the main golf club carrying bag, wherein the lower attachment mechanism comprises a post and receptacle configuration, the post being received by the receptacle to connect the bottom portion of the smaller golf club carrying bag with the bottom portion of the main golf club carrying bag, the main golf club carrying bag further comprising a support plate extending radially from the bottom of the main golf club carrying bag, such that when the bags are coupled, the bottom of the smaller golf club carrying bag is seated on the support plate, the post extending from the support plate and received by the receptacle, the receptacle being position in the bottom of the smaller golf carrying bag.

11. The golf bag of claim 10, wherein the upper male portion protrudes from one of the first outer surfaces toward the other golf club carrying bag when the golf club carrying bags are in a position to be coupled.

12. The golf bag of claim 11, wherein the upper female portion is inset within one of the first outer surfaces opposite the upper male portion.

13. The golf bag of claim 10, wherein the upper female portion and the upper male portion are substantially laterally centered on the first outer surfaces.

14. The golf bag of claim 13, wherein the upper female portion is a catch inset within first outer surface and the upper male portion is a latch protruding from the first outer surface.

15. The golf bag of claim 14, further comprising a hook and loop patches applied to the first outer surfaces to further secure the smaller golf club carrying bag to the main golf club carrying bag.

16. The golf bag as in claim 9, the main golf club carrying bag further comprising a support plate extending radially from the bottom of the main golf club carrying bag, such that when the bags are coupled, the bottom of the smaller golf club carrying bag is seated on the support plate, the post extending from the support plate.

17. The golf bag as in claim 10, wherein, when the bags are coupled, a conduit is formed laterally between the bags, the conduit being sized to receive a retaining strap from a golf cart.

18. The golf bag as in claim 1, wherein the first outer surfaces are substantially flat.

19. The golf bag as in claim 18, the smaller golf club carrying bag have a cross-section, wherein the cross-section is has a semi-circle configuration.

20. The golf bag as in claim 10, the smaller golf club carrying bag have a cross-section, wherein the cross-section is has a semi-circle configuration.

21. The golf bag as in claim 5, the coupling mechanism further comprising a lower attachment mechanism being associated with the bottom portion of the smaller golf club carrying bag and the main golf club carrying bag, lower attachment mechanism connecting the bottom portion of the smaller golf club carrying bag to the bottom portion of the main golf club carrying bag, wherein the lower attachment mechanism comprises a post and receptacle configuration, the post being received by the receptacle to connect the bottom portion of the smaller golf club carrying bag with the bottom portion of the main golf club carrying bag, the main golf club carrying bag further comprising a support plate extending radially from the bottom of the main golf club carrying bag, such that when the bags are coupled, the bottom of the smaller golf club carrying bag is seated on the support plate, the post extending from the support plate.

22. The golf bag of claim 14, further comprising a hook and loop patches applied to the first outer surfaces to further secure the smaller golf club carrying bag to the main golf club carrying bag.

* * * * *